US007594655B2

(12) United States Patent
Wu et al.

(10) Patent No.: US 7,594,655 B2
(45) Date of Patent: Sep. 29, 2009

(54) PAPER FEED APPARATUS FOR DUPLEX PRINTING APPARATUS

(75) Inventors: Kuo-Kuang Wu, Hsinchu (TW); Wei-Yuan Peng, Hsinchu (TW); Min-Hsi Liu, Hsinchu (TW)

(73) Assignee: Foxline Image Technology Co., Ltd., Hsinchu (TW)

( * ) Notice: Subject to any disclaimer, the term of this patent is extended or adjusted under 35 U.S.C. 154(b) by 324 days.

(21) Appl. No.: 11/768,822

(22) Filed: Jun. 26, 2007

(65) Prior Publication Data

US 2009/0001655 A1 Jan. 1, 2009

(51) Int. Cl.
*B65H 5/00* (2006.01)

(52) U.S. Cl. ..... 271/225; 271/9.02; 271/3.14; 271/4.04; 271/3.18; 271/3.19; 271/184

(58) Field of Classification Search ..... 271/225, 271/9.02, 3.14, 4.04, 3.18, 3.19, 184
See application file for complete search history.

(56) References Cited

U.S. PATENT DOCUMENTS 5,594,486 A * 1/1997 Kiyohara ..... 347/104
7,530,568 B2 * 5/2009 Uchida et al. ..... 271/273
2008/0224385 A1 * 9/2008 Takahira et al. ..... 271/225

* cited by examiner

*Primary Examiner*—Patrick H Mackey
*Assistant Examiner*—Prasad V Gokhale
(74) *Attorney, Agent, or Firm*—WPAT, P.C.; Anthony King; Kay Yang

(57) ABSTRACT

A paper feed apparatus includes a gate, an actuator, a transmission, a pickup device, a reversing device, a paper feed device. The gate has a rack defined at one end of the gate and a resilient arm connecting to the outer portion of the rack. The resilient arm has a plurality of external teeth. The actuator has a pickup gear with a disc-shaped body, an external wheel connecting to the outside of the body and an external gear connecting to the outside of the external wheel. A receiving passage is defined through the pickup gear along the axis thereof. The receiving passage includes a holding hole at one side of the receiving passage that is near to the rack. The resilient arm is inserted into the receiving passage with the external teeth abutting against the inner surface of the holding hole.

2 Claims, 12 Drawing Sheets

PAPER FEED APPARATUS FOR DUPLEX PRINTING APPARATUS

BACKGROUND OF THE INVENTION

1. Field of the Invention

The present invention relates to a duplex printing apparatus, and more particularly to a paper feed apparatus for reversing a paper feed path for duplex printing.

2. The Related Art

A duplex printing apparatus includes a duplex printing master on which two sides of a sheet are printed in series. The sheet is printed by pressing a front side of the sheet against the duplex printing master through a paper feed apparatus. The other side of the sheet is printed by pressing a reverse side of the sheet against the duplex printing master through the paper feed apparatus. So the paper feed apparatus can achieve the reverse of the sheet.

Referring to FIG. 1, a conventional paper feed apparatus 700 includes a gate 710, an actuator 720, a transmission 730, a pickup device 740, a reversing device 750, a paper feed device 760.

Referring to FIG. 2 and FIG. 3, the actuator 720 comprises a pickup gear 721, an arm 722 and a pickup idler gear 723 which has a same angular speed with the pickup gear 721. The arm 722 mounted between the pickup gear 721 and the pickup idler gear 723 has a friction spring 724 that can cause a torque.

Refer to FIG. 4 and FIG. 5. When a sheet is fed to the paper feed device 760, the gate 710 is in a closed position while the arm 722 is pressed by the actuator 720. The pickup gear 721 is reversed following a motor while the sheet will leave the paper feed device 760, and then the torque caused between the pickup gear 721 and the arm 722 rises the arm 722 to make the gate 710 be in an open position. The sheet is fed to the paper feed device 760 through the reversing device 750 again to achieve duplex printing.

Based on the conventional art, the components of the paper feed apparatus 700 are too many to ensure the paper feed apparatus 700 working effectively. So, it would be desirable to provide a paper feed apparatus 700 that is of simple design and low cost.

SUMMARY OF THE INVENTION

An object of the present invention is to provide a paper feed apparatus being of simple design and low cost. The paper feed apparatus includes a gate, an actuator, a transmission, a pickup device, a reversing device, a paper feed device. The gate has a rack defined at one end thereof and a resilient arm connecting to an outer portion of the rack. The resilient arm has a pillar-base and a plurality of external teeth apart from each other extending outward from an outer portion of the pillar-base. The outer surfaces of the external teeth are in a same ball surface. The external teeth have a top portion with a biggest outer diameter between an inner portion and an outer portion. The actuator has a pickup gear with a disc-shaped body, an external wheel connecting to the outside of the body and an external gear connecting to the outside of the external wheel. A stepper gear is overlaid about the external wheel and connected with the body. A receiving passage is defined through the pickup gear along the axis thereof, the receiving passage has a holding hole at the inner side and an external hole communicating with the holding hole with a smaller size at the outer side, then a shoulder is formed between the holding hole and the external hole. The external teeth of the resilient arm are inserted into the receiving passage with an inward shrink, the top portion of the external teeth abuts against the inner surface of the holding hole, the outer portion of the external teeth presses against the shoulder.

As described above, the friction created between the resilient arm and the pickup gear can control the gate to allow the sheet to enter into the reversing device for duplex printing. As the component of the paper feed apparatus are small, the paper feed apparatus works smoothly to avoid the gate not working effectively.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
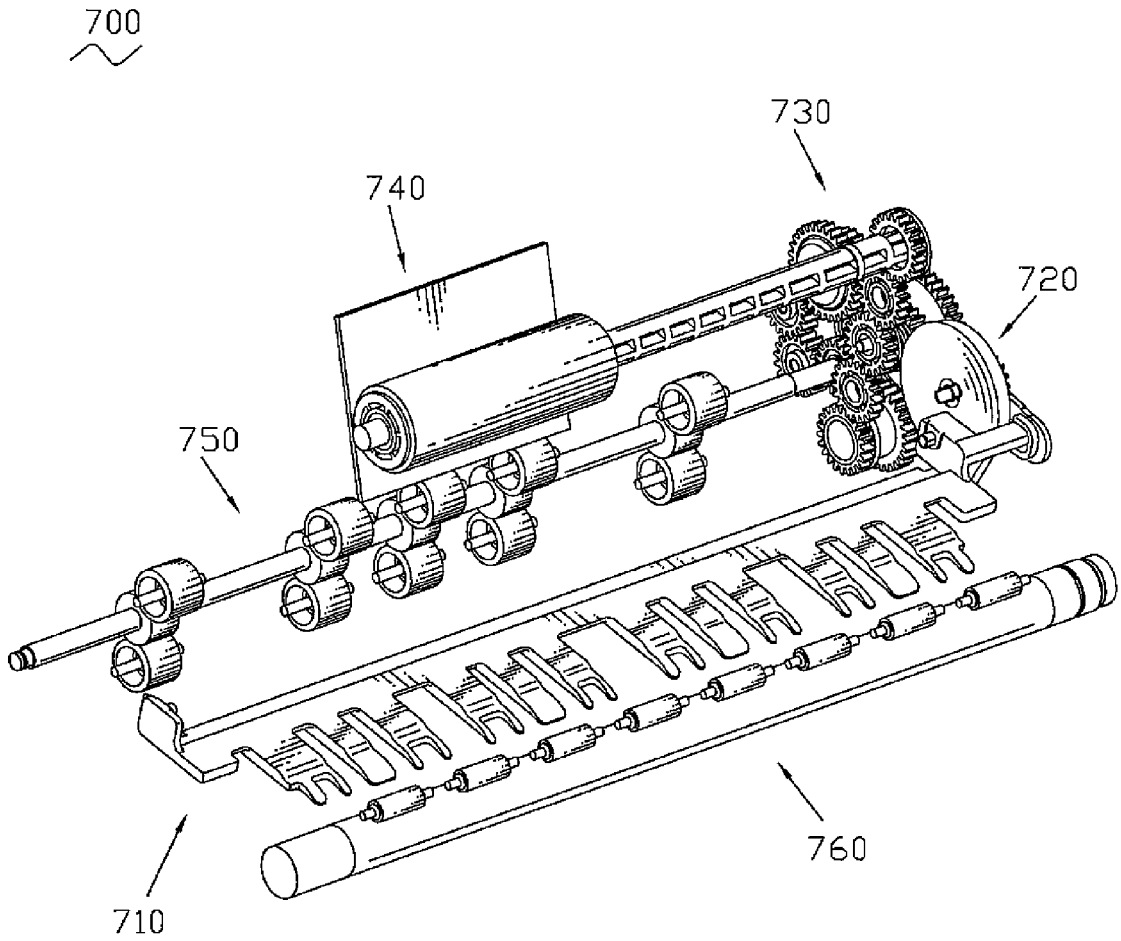
FIG. 1 Prior Art
FIG. 1 is a perspective view of a conventional paper feed apparatus.
Figure 2:
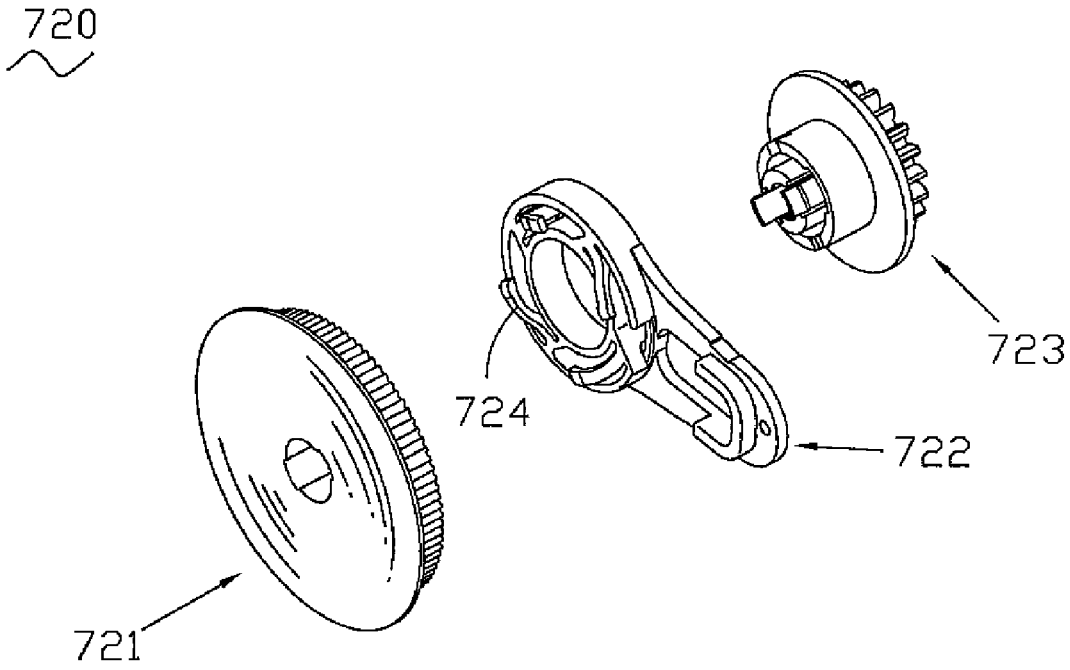
FIGS. 2-3 are exploded views of an actuator of the conventional paper feed apparatus.
Figure 3:
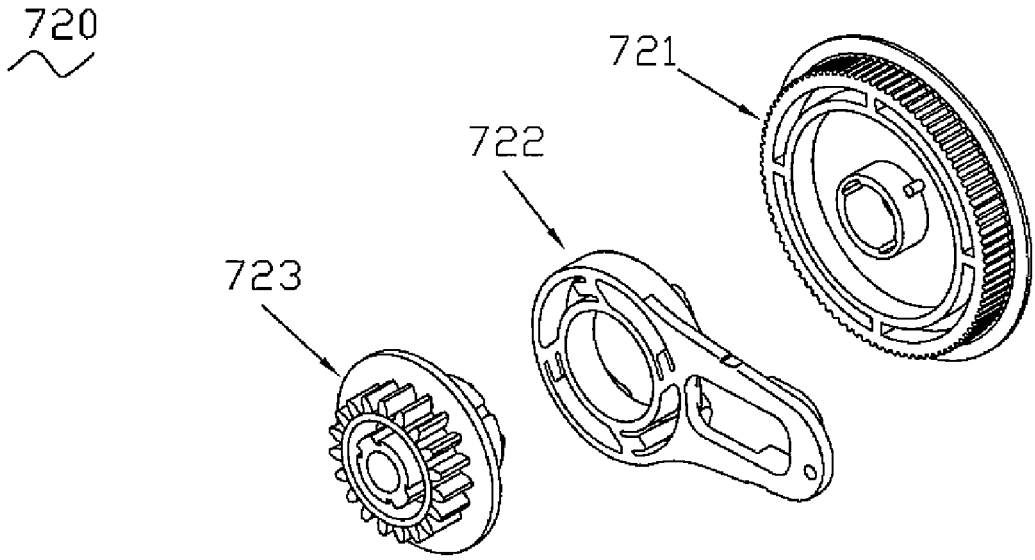
FIG. 3 Prior Art
Figure 4:
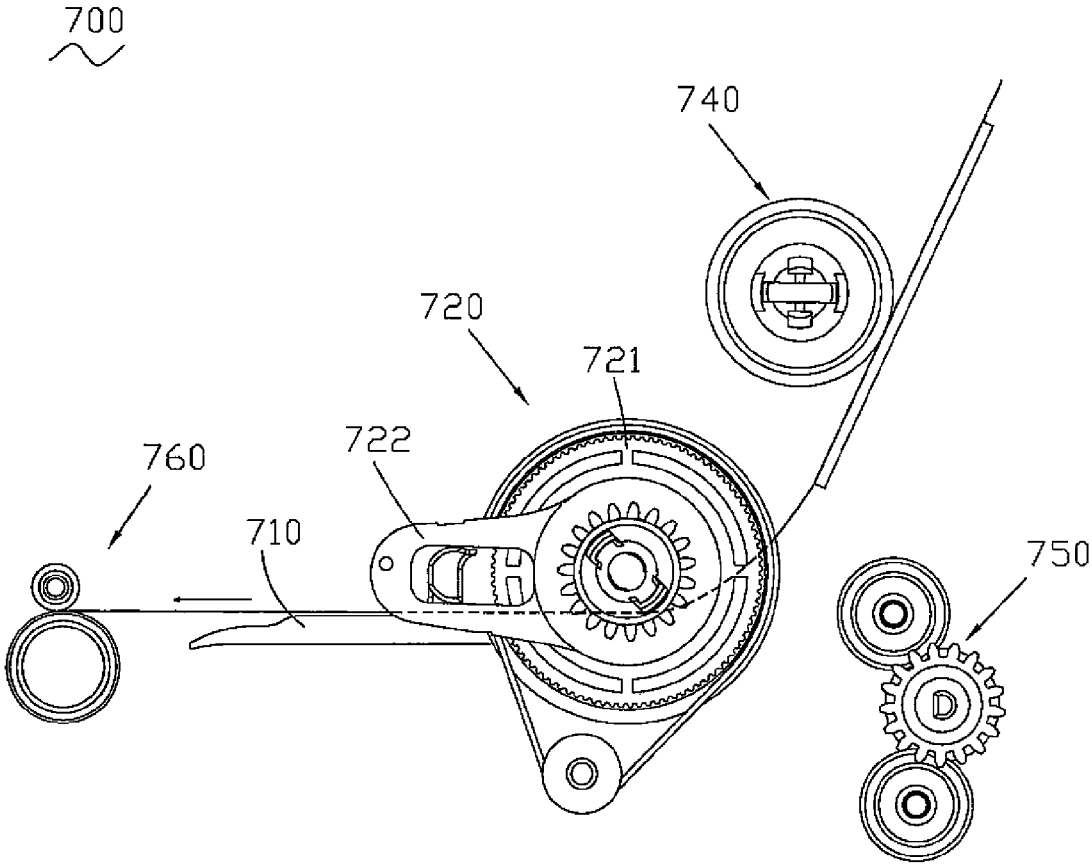
FIG. 4 Prior Art
FIGS. 4-5 are perspective views for describing operations of the conventional paper feed apparatus.
Figure 5:
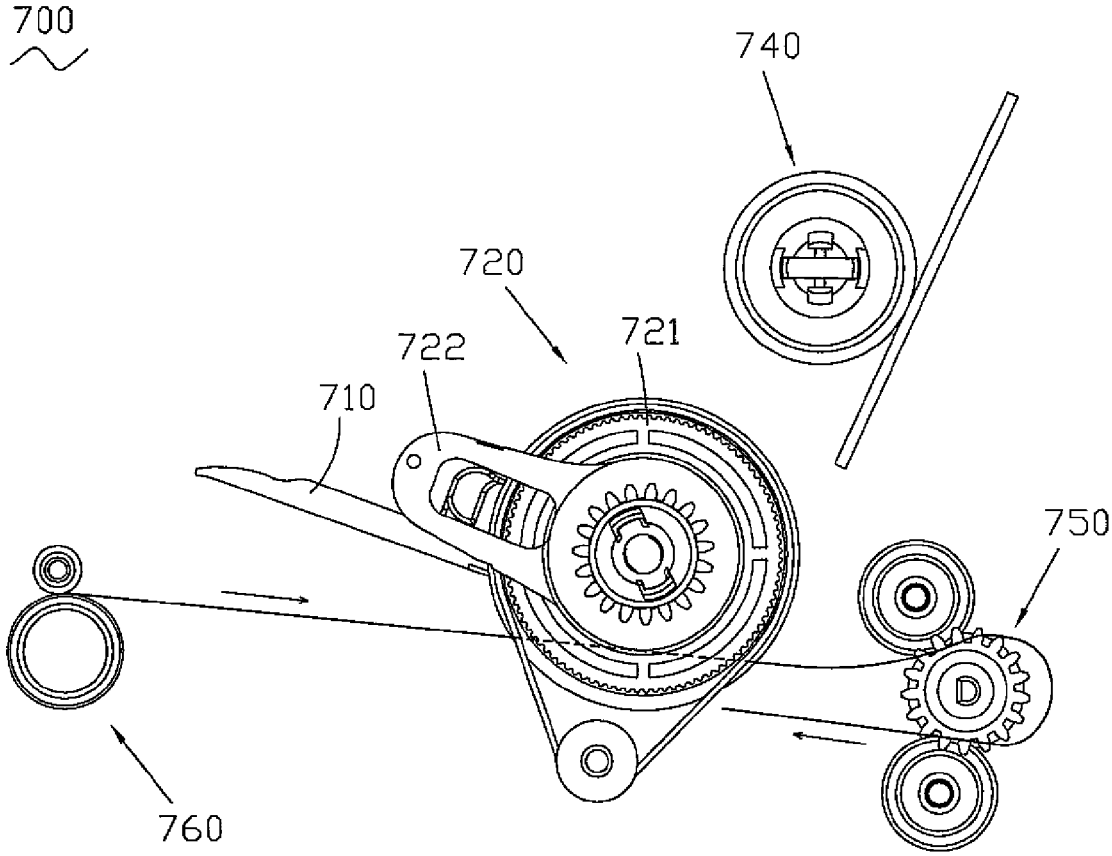
FIG. 5 Prior Art
Figure 6:
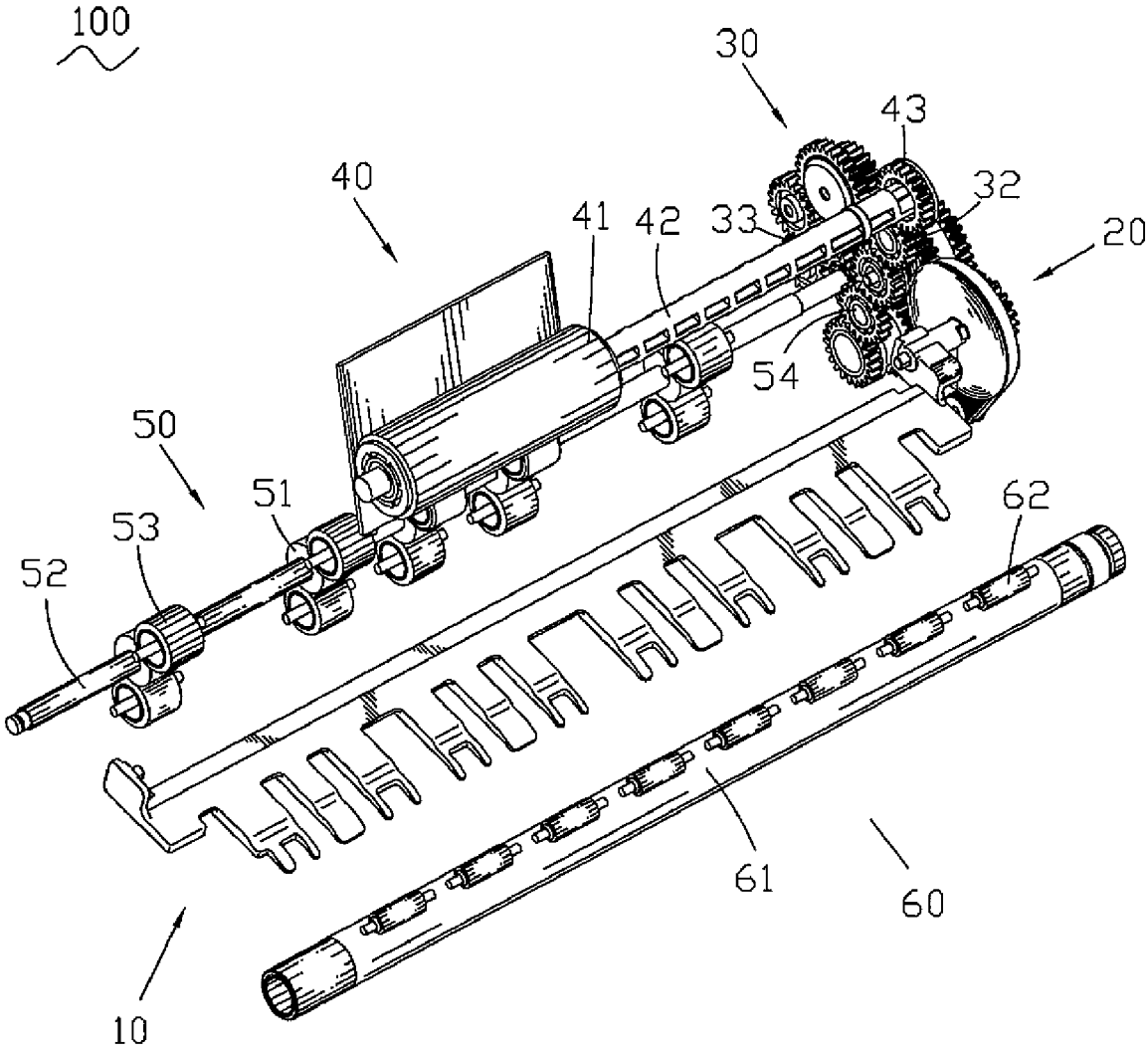
FIG. 6 is a perspective view of a paper feed apparatus.

With reference to FIG. 6, a paper feed apparatus 100 includes a gate 10, an actuator 20, a transmission 30, a pickup device 40, a reversing device 50, a paper feed device 60.

Figure 7:
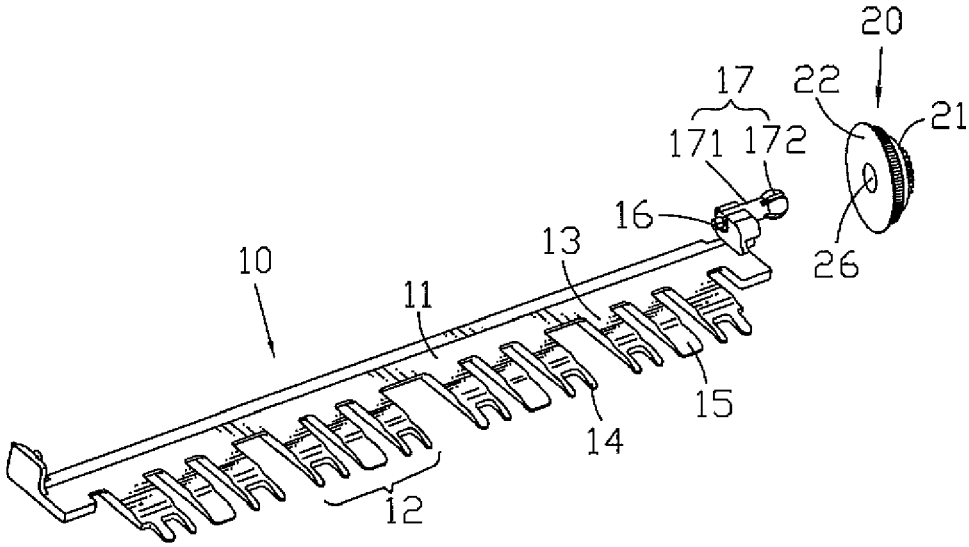
FIGS. 7-8 are perspective views of a gate and an actuator of the paper feed apparatus.
Figure 8:
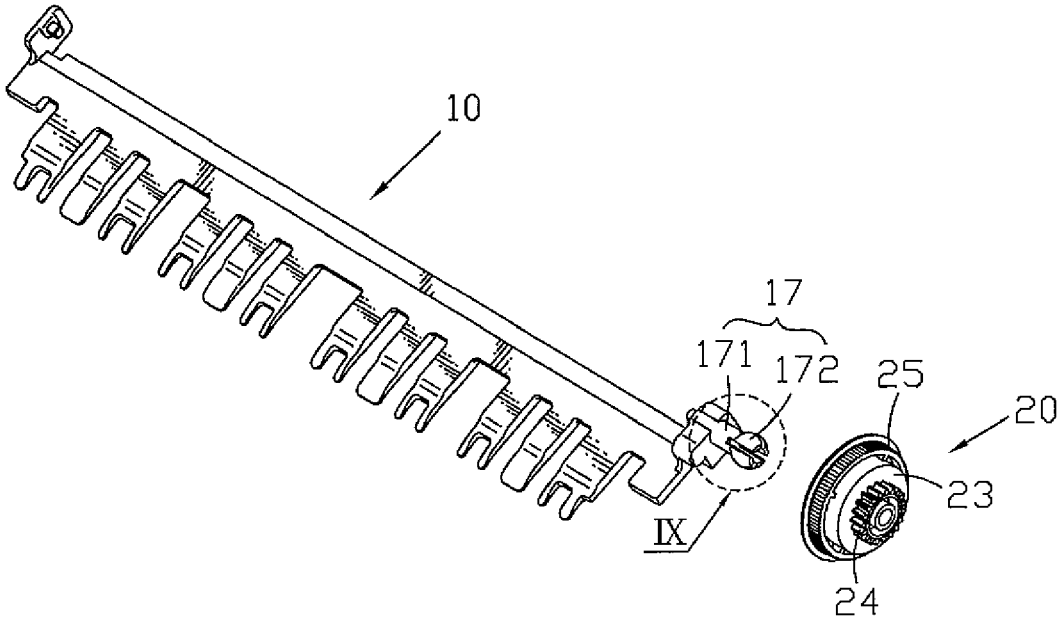

Referring to FIG. 7 and FIG. 8, the gate 10 has a thin and level board-shaped base 11, and a set of pivotal portions 12 extending outward from one side of the base 11. Each of the pivotal portions 12 has three pivotal boards 13. Two of the pivotal boards 13 which are located at two sides of the pivotal portions 12 have a plurality of teeth 14 extending outward from the outside of the pivotal boards 13. One of the pivotal boards 13 which is located at the middle of the pivotal portions 12 has a pressboard 15 extending outward from the outside thereof.

Figure 9:
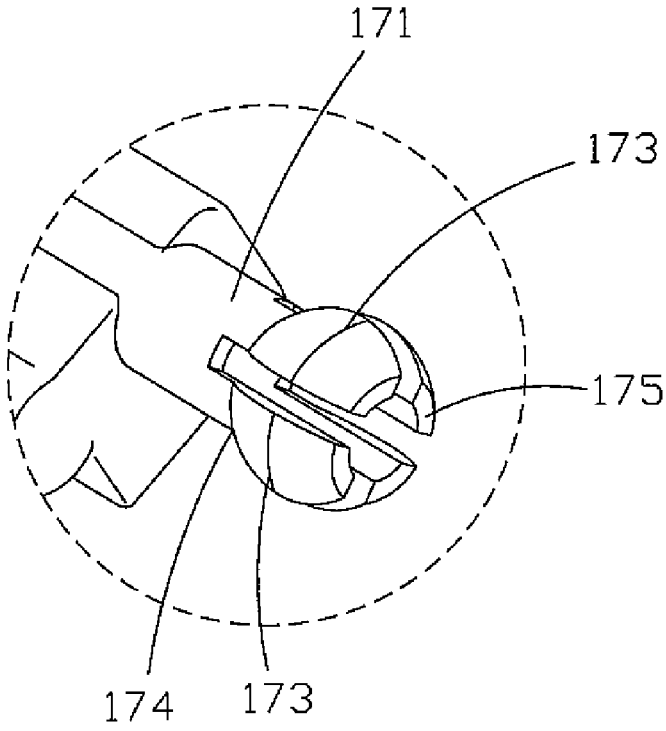
FIG. 9 is a partial enlarged view of the encircled portion labeled IX shown in FIG. 8.

Referring to FIG. 7, FIG. 8 and FIG. 9, a rack 16 is defined at one end of the gate 10 which is near to the actuator 20. The rack 16 defines a resilient arm 17 that connects to an outer portion of the rack 16. The resilient arm 17 has a pillar-base 171 and a plurality of external teeth 172 apart from each other extending outward from an outer portion of the pillar-base 171. The outer surfaces of the external teeth 172 are in a same ball surface. The external teeth 172 have a top portion 173 with a biggest outer diameter between an inner portion 174 and an outer portion 175.

Referring to FIG. 7 and FIG. 8 again, the actuator 20 comprises a pickup gear 21 with a disc-shaped body 22, an external wheel 23 connecting to the outside of the body 22 and an external gear 24 adjacent to the outside of the external wheel 23. A stepper gear 25 connected with the body 22 is overlaid about the external wheel 23. A belt is sleeved on both the stepper gear 25 and a motor (not shown), and impels the pickup gear 21 to rotate. A receiving passage 26 that receives the resilient arm 17 is defined through the pickup gear 21 along the axis thereof.

Figure 10:
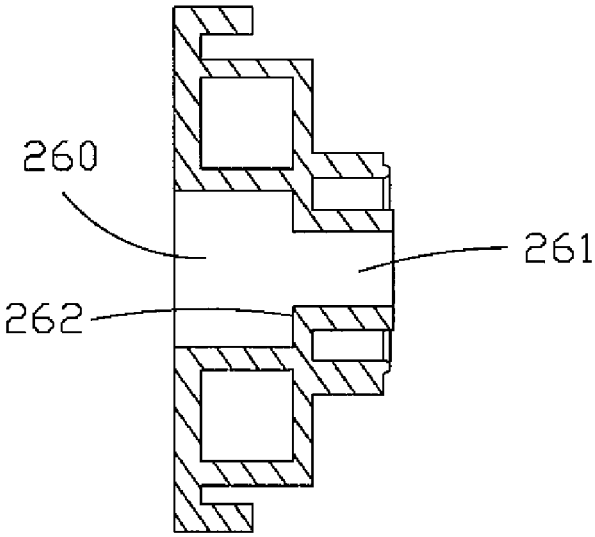
FIG. 10 is a cross-sectional view of a pickup gear of the paper feed apparatus.

Referring to FIG. 7, FIG. 8 and FIG. 10, the receiving passage 26 comprises a holding hole 260 at one side of the receiving passage 26 which is near to the rack 16 and an external hole 261 connecting with the holding hole 260 at the other side of the receiving passage 26 which is distant from the rack 16. The size of the holding hole 260 is bigger than the size of the external hole 261, therefore, a shoulder 262 is formed between the holding hole 260 and the external hole 261.

Figure 11:
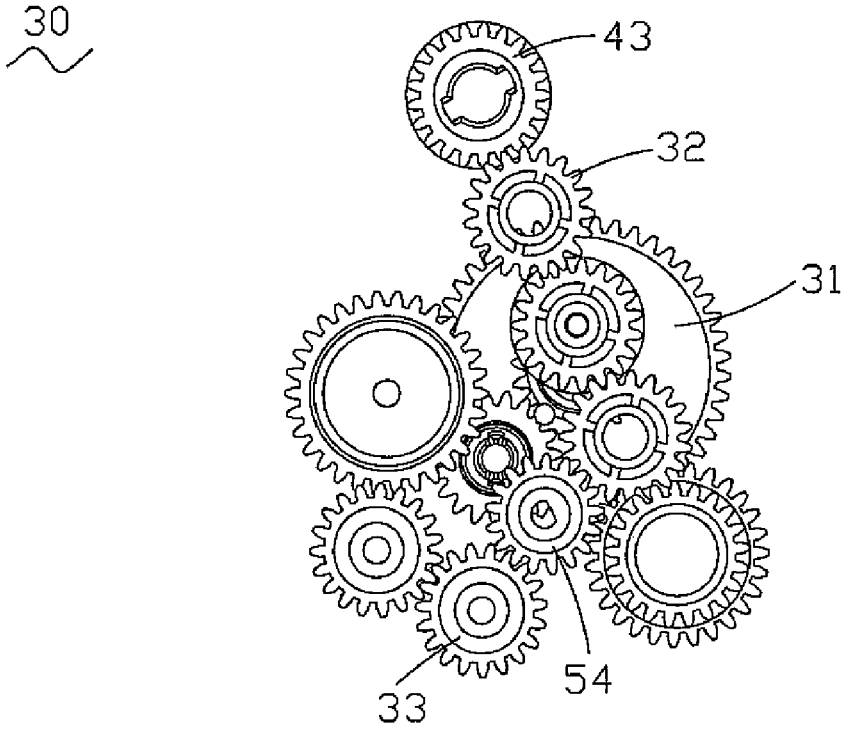
FIGS. 11-12 are perspective views of a transmission of the paper feed apparatus.
Figure 12:
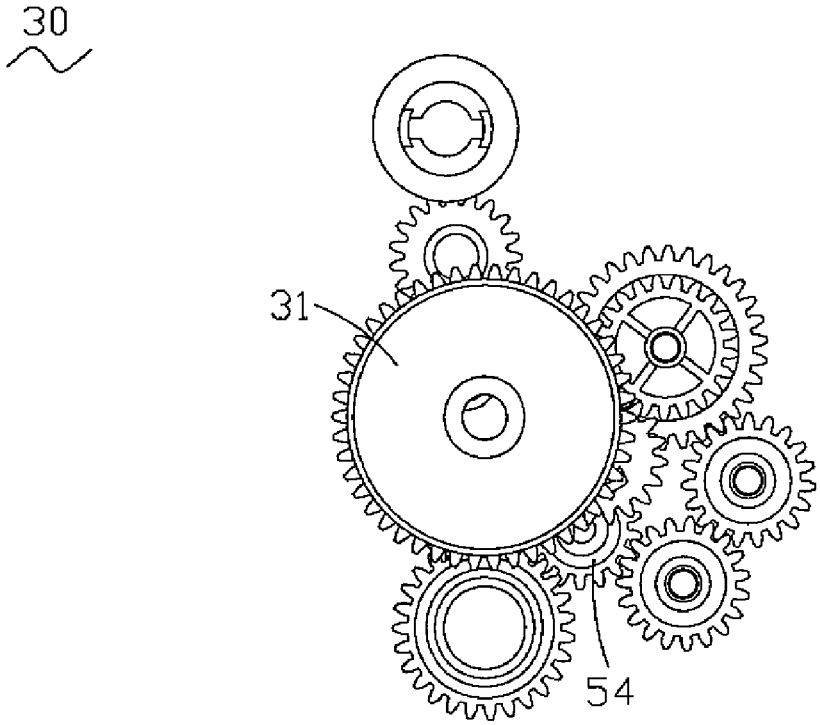

Referring to FIG. 6, FIG. 11 and FIG. 12, the transmission 30 has a first gear 31 engaging with the external gear 24, a second gear 32, a third gear 33.

Referring to FIG. 6 again, the pickup device 40 has a picking roller 41, a short shaft 42, a picking gear 43. The picking roller 41 is twined on one end of the short shaft 42 to extract pluralities of sheets and the picking gear 43 that engages with the second gear 32 is twined on the other end of the short shaft 42 to provide a power of the picking roller 41 for rotating.

The reversing device 50 has a reversing roller 51, a long shaft 52, a reversing idle roller 53 and a reversing gear 54. The reversing roller 51 is twined on the middle of the long shaft 52. The reversing idle roller 53 is mounted in a corresponding location of the paper feed apparatus 100 to couple with the reversing roller 51 to reverse the sheets. The reversing gear 54 is twined on end of the long shaft 52 that is near to the transmission 30 to engage with the third gear 33.

The paper feed device 60 has a pickup roller 61 and a pickup idle roller 62 coupled with the pickup roller 61. The paper feed device 60 is configured in a corresponding location to guide the sheets to enter into the paper feed apparatus 100. The pickup roller 61 presses against the pickup idle roller 62 to extract the sheets.

Figure 13:
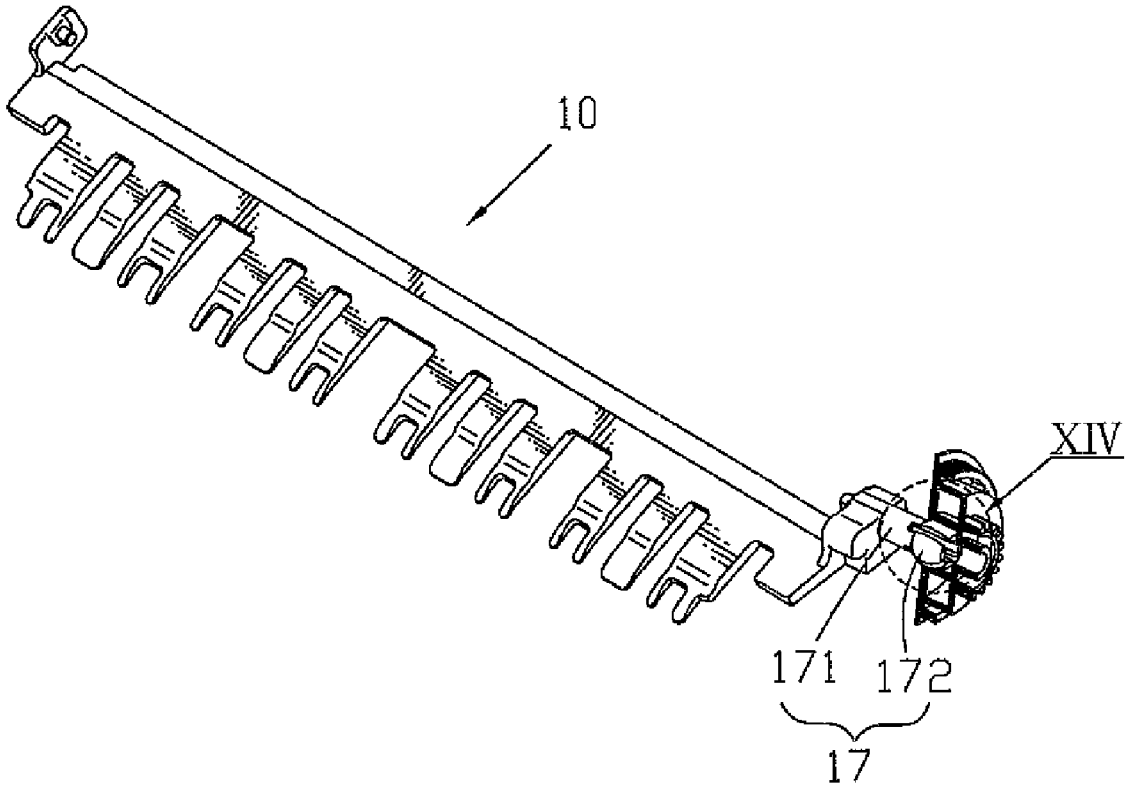
FIG. 13 is a cross-sectional view of the resilient arm, by inserting into the pickup gear.

When the paper feed apparatus 100 is in assembly, the belt is sleeved on both the external gear 24 and the motor. The external teeth 172 of the resilient arm 17 are inserted into the receiving passage 26 with an inward shrink. The top portion 173 of the external teeth 172 abuts against the inner surface of the holding hole 260, the outer portion 175 of the external teeth 172 presses against the shoulder 262 (shown in FIG. 13, FIG. 14). The short shaft 42 and the long shaft 52 are sleeved in the corresponding places of the paper feed apparatus 100.

Figure 14:
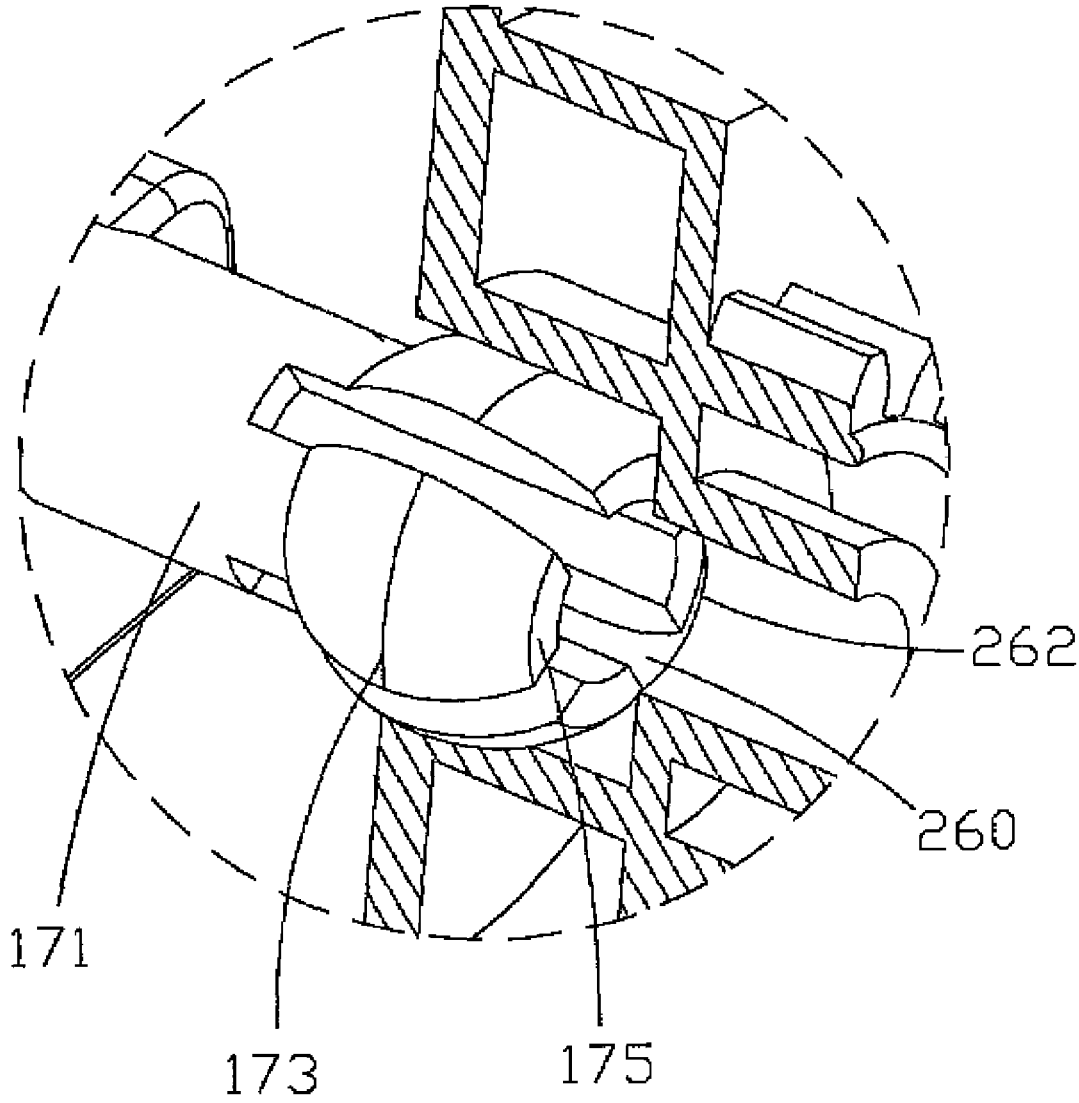
FIG. 14 is a partial enlarged view of the encircled portion labeled X IV shown in FIG. 13.
Figure 15:
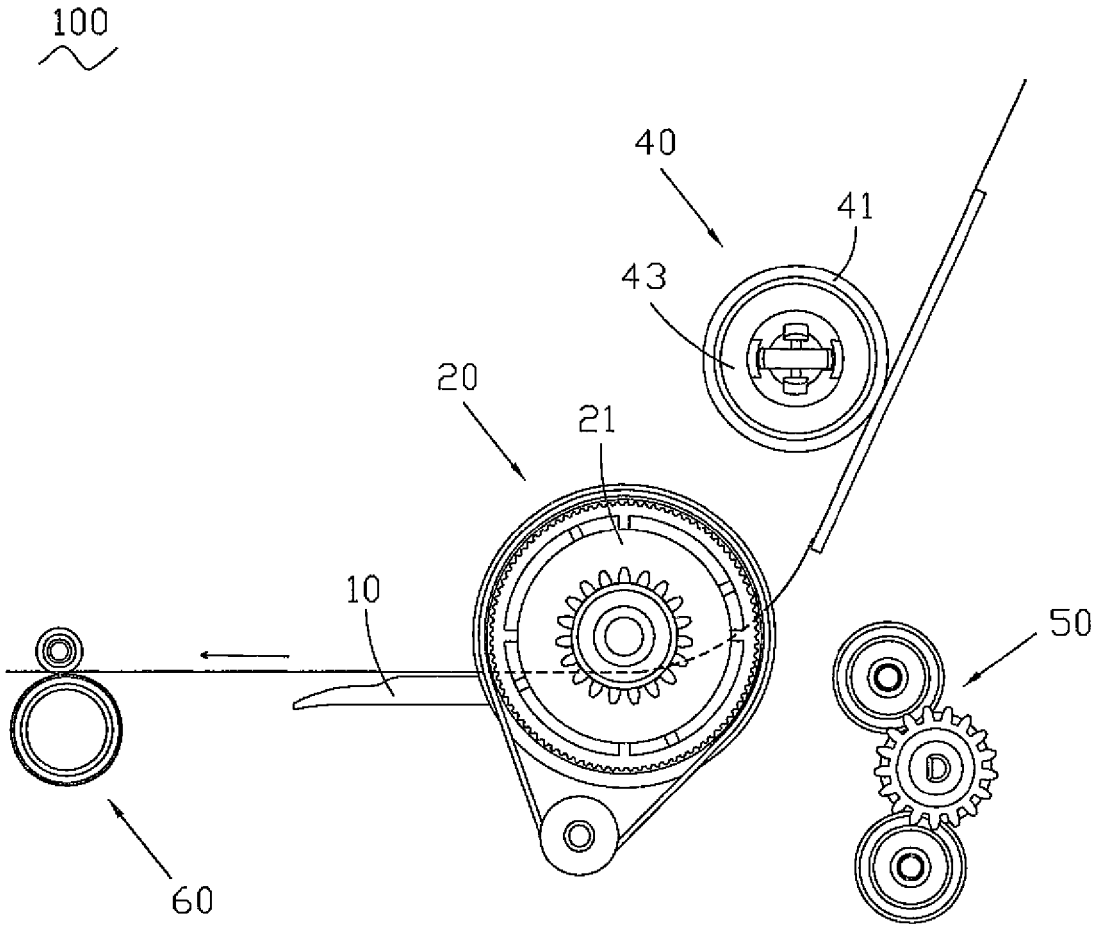
FIGS. 15-16 are perspective views for describing operations of the paper feed apparatus.

Referring to FIG. 7, FIG. 14 and FIG. 15, when the paper feed apparatus 100 picks up the sheet, the motor drives the stepper gear 25 to rotate anti-clockwise, and the external gear 24 rotates anti-clockwise following the stepper gear 25, then the picking gear 43 rotates clockwise, and the picking roller 41 also rotates clockwise. The picking roller 41 extracts the sheet by a friction created between the picking roller 41 and the sheet. Meanwhile, as the resilient arm 17 moves downward, the gate 10 is in a closed position to guide the sheet into the paper feed device 60 to be printed one side of the sheet through a duplex printing master (not shown).

Figure 16:
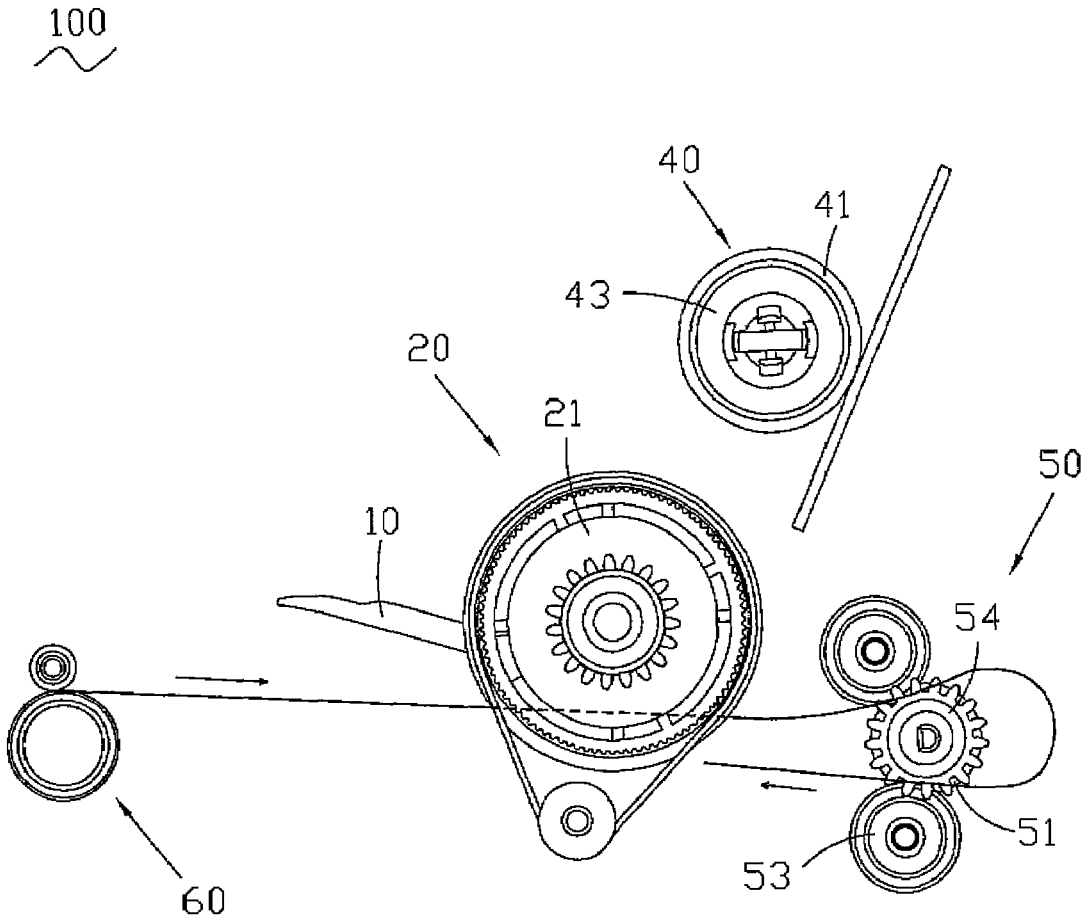

Referring to FIG. 16, on the contrary, when the sheet will leave the paper feed device 60, the motor drives the pickup gear 21 to rotate clockwise, then the picking gear 43 rotates anti-clockwise, and the picking roller 41 also rotates anti-clockwise. The picking roller 41 doesn't extract the sheet. Meanwhile, as the resilient arm 17 moves upward by the friction created between the holding hole 260 and the resilient arm 17, the gate 10 is in an open position to guide the sheet one side of which have been printed to enter into the reversing device 50. The reversing gear 54 rotates clockwise, and the reversing roller 51 also rotates clockwise. The friction created between the reversing roller 51 and the sheet guides the sheet into the paper feed device 60 to be printed the other side of the sheet through the duplex printing master.

As described above, the resilient arm 17 of the paper feed apparatus 100 replaces the arm 22' of the conventional paper feed apparatus 100'. The friction created between the resilient arm 17 and the pickup gear 21 can control the gate 10 to allow the sheet to enter into the reversing device 50 for duplex printing. As the components of the paper feed apparatus 100 are small, the paper feed apparatus 100 works smoothly to avoid the gate 10 not working effectively.

What is claimed is:

1. A paper feed apparatus comprising:

a gate having a rack defined at one end thereof and a resilient arm connecting to an outer portion of the rack, the resilient arm having a pillar-base and a plurality of external teeth apart from each other extending outward from an outer portion of the pillar-base, the outer surfaces of the external teeth being in a same ball surface, the external teeth having a top portion with a biggest outer diameter between an inner portion and an outer portion;

an actuator having a pickup gear with a disc-shaped body, an external wheel connecting to the outside of the body and an external gear connecting to the outside of the external wheel, a stepper gear being overlaid about the external wheel and connected with the body for engaging with a motor, a receiving passage being defined through the pickup gear along the axis thereof, the receiving passage having a holding hole at the inner side and an external hole communicating with the holding hole with a smaller size at the outer side, then a shoulder being formed between the holding hole and the external hole;

a transmission having a first gear engaging with the external gear, a second gear and a third gear;

a pickup device having a short shaft, a picking roller fitted around one end of the short shaft which is near to the transmission, and a picking gear for extracting sheets, said picking roller engaging with the second gear of the transmission;

a reversing device having a long shaft, a reversing roller, a reversing idle roller coupled with a reversing gear for reversing the sheets, and the reversing rear fitted around one end of the long shaft which is near to the transmission, said reversing gear engaging with the third gear of the transmission; and a paper feed device having a pickup roller and a pickup idle roller coupled with the pickup roller;

wherein the external teeth of the resilient arm are inserted into the receiving passage with an inward shrink, the top portion of the external teeth abuts against the inner surface of the holding hole, the outer portion of the external teeth presses against the shoulder.

2. The paper feed apparatus as claimed in claim 1, wherein the paper feed apparatus further comprises a belt fitted around the stepper gear and the motor to impel the pickup gear to rotate.

* * * * *